US010192647B2

(12) United States Patent
Babinet et al.

(10) Patent No.: US 10,192,647 B2
(45) Date of Patent: Jan. 29, 2019

(54) PACKAGE COMPRISING IMPROVED MEANS OF DAMPENING IMPACT BETWEEN AN ASSEMBLY CONTAINING RADIOACTIVE MATERIALS AND THE COVER OF THE PACKAGING

(71) Applicant: TN International, Montigny le Bretonneux (FR)

(72) Inventors: Cyril Babinet, Paris (FR); Pierre-Olivier Pontet, Lyons (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 347 days.

(21) Appl. No.: 14/914,921

(22) PCT Filed: Sep. 4, 2014

(86) PCT No.: PCT/EP2014/068815
§ 371 (c)(1),
(2) Date: Feb. 26, 2016

(87) PCT Pub. No.: WO2015/032848
PCT Pub. Date: Mar. 12, 2015

(65) Prior Publication Data

US 2016/0225474 A1 Aug. 4, 2016

(30) Foreign Application Priority Data

Sep. 5, 2013 (FR) ..... 13 58506

(51) Int. Cl.
*B65D 85/84* (2006.01)
*B65D 85/62* (2006.01)
(Continued)

(52) U.S. Cl.
CPC ..... *G21F 5/08* (2013.01); *B65D 81/02* (2013.01); *G21F 5/005* (2013.01); *G21F 5/12* (2013.01)

(58) Field of Classification Search
CPC ... B65D 81/02; G21F 5/08; G21F 5/12; G21F 5/005
(Continued)

(56) References Cited

U.S. PATENT DOCUMENTS 3,216,561 A * 11/1965 Knapp ..... B65D 81/113 206/523
4,114,761 A * 9/1978 Kleiner ..... B65D 81/027 206/591
4,625,908 A * 12/1986 Emery ..... B65D 5/503 206/427
7,186,993 B2 3/2007 Timpert
(Continued)

FOREIGN PATENT DOCUMENTS

JP S63-26439 A 2/1988
JP 2011-013035 A 1/2011

OTHER PUBLICATIONS

Search Report issued in French Patent Application No. FR 13 58506 dated May 2, 2014.
International Search Report and Written Opinion issued in Application No. PCT/EP2014/068815 dated Nov. 11, 2014.
International Preliminary Report on Patentability issued in Application No. PCT/EP2014/068815 dated Aug. 21, 2015.

*Primary Examiner* — Luan K Bui
(74) *Attorney, Agent, or Firm* — Pearne & Gordon LLP

(57) ABSTRACT

The invention relates to a package comprising a packaging for storing and/or transporting radioactive materials and an assembly containing radioactive materials (16) housed in a cavity of the packaging closed by a cover (6), the package comprising a system for dampening impact of the assembly against the cover (6), the system comprising at least one
(Continued)

deformable dampening device (42) and a loading device (26) of the deformable dampening device. According to the invention, one of the devices (42) is mounted moveable on the cover (6) in a plane orthogonal to the axis (8) of the packaging, and has means (50) of self-centering relatively to the other of the devices (26), provided on the assembly containing the radioactive materials (16).

14 Claims, 7 Drawing Sheets

(51) Int. Cl.

| | |
|---|---|
| ***G21F 5/08*** | (2006.01) |
| ***G21F 5/005*** | (2006.01) |
| ***G21F 5/12*** | (2006.01) |
| ***B65D 81/02*** | (2006.01) |

(58) Field of Classification Search
USPC ..... 206/499, 521, 524.4, 524.5, 591–594
See application file for complete search history.

(56) References Cited

U.S. PATENT DOCUMENTS

| | | | | |
|---|---|---|---|---|
| 8,657,109 | B2 * | 2/2014 | Ouzts ..... | B65D 25/10 206/217 |
| 2007/0023303 | A1 * | 2/2007 | Templeton ..... | B65D 43/162 206/318 |
| 2008/0135445 | A1 * | 6/2008 | Juliano ..... | B65D 5/503 206/592 |
| 2011/0158372 | A1 | 6/2011 | Saito | |

* cited by examiner

PACKAGE COMPRISING IMPROVED MEANS OF DAMPENING IMPACT BETWEEN AN ASSEMBLY CONTAINING RADIOACTIVE MATERIALS AND THE COVER OF THE PACKAGING

TECHNICAL FIELD

The present invention relates to the field of packages of radioactive materials, comprising a packaging and an assembly containing radioactive materials housed in a cavity defined by the packaging. Said assembly may for example comprise waste canisters or nuclear fuel vessels.

BACKGROUND ART

A package for storing and/or transporting radioactive materials generally comprises, as outer containment, a packaging having a lateral body, a bottom and a cover. These parts of the packaging define a cavity for housing an assembly containing radioactive materials, for example a basket housing nuclear fuel assemblies or waste canisters.

The safety demonstration of the packaging loaded with the assembly is based in particular on regulatory drop tests. In the case of a drop from a height of 9 meters in the direction of the axis of the packaging passing through the bottom and the cover thereof, on the head dampening overcap covering the cover of the packaging, the total weight of the assembly containing the radioactive materials presses on said same cover during impact on the ground. During this drop, known as "axial drop", very considerable stresses are generated in the system of closing the cover on the lateral body of the packaging. In particular, the fixing screws are highly stressed, and, under certain conditions, the moveable assembly in the cavity of the packaging can impact the cover with a particularly damaging effect on the closing system.

In order to assure the leak tightness of the packaging after the axial drop, it may thus prove to be necessary to limit the stresses transmitted by the assembly on the cover, by means of an impact dampening system placed on the inner surface of the cover.

Generally, such a system comprises at least one deformable dampening device and a loading device associated with said dampening device. The two aforementioned devices are respectively fixed on the assembly containing the radioactive materials and on the inner surface of the cover. For example, in the case where said assembly integrates canisters, each canister placed opposite the cover integrates a deformable dampening device whereas opposite the latter is placed a loading device in the form of a chock, fixed on the inner surface of the cover.

To obtain optimal crushing of the dampening device, and thus dissipate as best as possible the mechanical energy through the deformation of the dampening device, precise alignment is required between the latter and its associated loading device.

Yet, although the cover of the packaging on which one of the devices is fixed is generally positioned precisely on the lateral body of the packaging, there exists on the other hand often significant lateral play between the assembly and the internal wall of the lateral body, particularly to enable the loading thereof in the cavity, thus creating an alignment defect.

In order to assure the best alignment possible between these two devices, it may thus be envisaged to considerably limit the lateral plays defining the position of the canisters with respect to the loading chocks. In other words, this leads in particular to reducing the play between the assembly containing the radioactive materials and the inner surface of the packaging lateral body.

The reduction of these lateral plays poses not only operational constraints during the loading of the canisters in the housings of the basket and during the loading of said basket in the cavity of the packaging, but also induces manufacturing constraints due to the necessity of managing low tolerances.

Obviously, these drawbacks presented within the scope of an assembly integrating canisters are encountered whatever the nature of said assembly, in other words whatever the shape of the devices containing the radioactive materials.

DESCRIPTION OF THE INVENTION

The aim of the invention is therefore to overcome, at least partially, the aforementioned drawbacks, relative to embodiments of the prior art.

To do so, the subject matter of the invention is a package comprising a packaging for storing and/or transporting radioactive materials and an assembly containing radioactive materials housed in a cavity of the packaging extending along a longitudinal axis of the packaging and being closed by a cover crossed by this axis, the package comprising a system for dampening impact of the assembly against the cover, the system comprising at least one plastically deformable dampening device and a loading device of said deformable dampening device.

According to the invention, one of the loading device and deformable dampening device is mounted moveable on the cover in a plane orthogonal to the axis of the packaging, and has means of self-centring relatively to the other of the two devices provided on said assembly containing the radioactive materials.

The invention thus makes it possible to obtain a satisfactory relative positioning of the two devices of the dampening system, whatever the position of the assembly containing the radioactive materials in the cavity of the packaging. A better efficiency of the dampening system ensues, without however requiring precise positioning of the assembly in the cavity. Consequently, the invention provides a simple and shrewd solution making it possible to respond on the one hand to the operational constraints during loading and on the other hand to the manufacturing constraints encountered with the conceptions of the prior art.

Preferably, said loading device is also a deformable dampening device. Also, in the event of axial drop on the cover, its deformation makes it possible to even better dissipate the mechanical energy of the drop. In this case, each of the two devices then fulfils on the one hand a deformable dampening function and, on the other hand, a function of loading of the other device.

Preferably, the assembly comprises a storage basket and devices containing radioactive materials placed in housings defined by said basket, and said other of the two devices is provided on one of the devices containing radioactive materials or on said basket. Alternatively, said devices containing radioactive materials may be placed directly in the cavity of the packaging, without storage basket.

Preferably, said other of the two devices is integrated in one of the devices containing radioactive materials, preferably at an end dedicated to its handling. Also, it is preferentially assured that the handling end of the device containing radioactive materials is provided to dampen impact in the event of axial drop on the cover.

Preferably, each device containing radioactive materials takes the form of a nuclear fuel vessel or a radioactive waste canister.

In this case, it is preferentially provided that said assembly containing radioactive materials comprises a plurality of canisters, stacked and spread out in several columns. In addition, each column of canisters is associated with a deformable dampening device and its associated loading device.

Preferably, the deformable dampening device and its associated loading device have respectively two truncated self-centring surfaces, of axes parallel to the axis of the packaging.

Preferably, said deformable dampening device has one or a plurality of plastically deformable dampening elements arranged between two load spreading plates.

Preferably, said deformable dampening device has an overall annular shape, said plastically deformable dampening elements being spread out circumferentially along the dampening device.

Preferably, said deformable dampening device comprises a mounting plate fixed on the cover of the packaging, said mounting plate covering a moveable plate of said deformable dampening device, said moveable plate being displaceable in a plane orthogonal to the axis of the packaging in a space defined between the mounting plate and the cover. Naturally, this type of lay out may also be retained when it is the loading device that is mounted moveable on the cover. Also, in this latter case, it is said loading device that comprises a mounting plate fixed on the cover of the packaging, the mounting plate covering a moveable plate of said loading device, said moveable plate being displaceable in a plane orthogonal to the axis of the packaging in a space defined between the mounting plate and the cover.

Whatever the case, said space takes the form of an annular slot open radially towards the exterior.

Nevertheless, other lay outs are possible to obtain the mobility of the dampening/loading device with respect to the cover. They may be for example legs or tongues passing through stirrups or similar with lateral plays to assure the mobility necessary for self-centring.

Preferably, said aforementioned moveable plate is one of said load spreading plates of the deformable dampening device. In this case, the conception remains simple since when said plate is annular, it is not necessary to mount on it additional elements to cooperate with the space defined between the mounting plate and the cover. In fact, the outer periphery or the inner periphery of said annular plate may be housed with play in the aforementioned space.

Preferably, said plastically deformable dampening elements are made of aluminium or of an alloy thereof.

Finally, the subject matter of the invention is also a method of closing a package as described above, comprising a step of self-centring the deformable dampening device relatively to its associated loading device, the step of self-centring being carried out automatically by displacement of said one of the loading device and deformable dampening device relatively to the cover, in a plane orthogonal to the axis of the packaging, during the mounting of the cover on a lateral body of the packaging.

Other advantages and characteristics of the invention will become clear in the non-limiting detailed description given below.

BRIEF DESCRIPTION OF THE DRAWINGS

This description will be made with reference to the appended drawings, among which.

DETAILED DESCRIPTION OF PARTICULAR EMBODIMENTS

Figure 1:
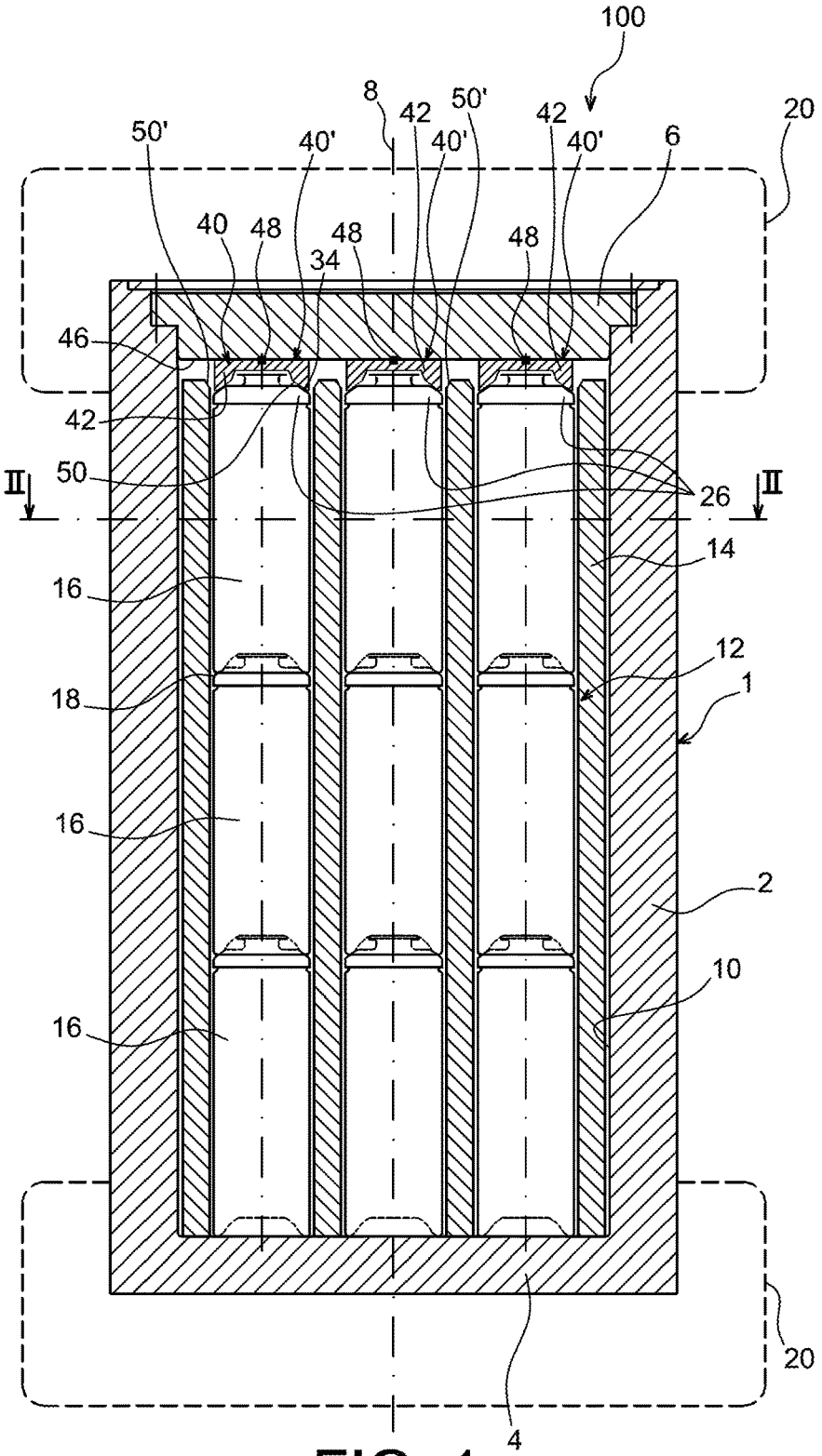
FIG. 1 represents a sectional view of a package according to a preferred embodiment of the present invention, the section being taken along the line I-I of FIG. 2.
Figure 2:
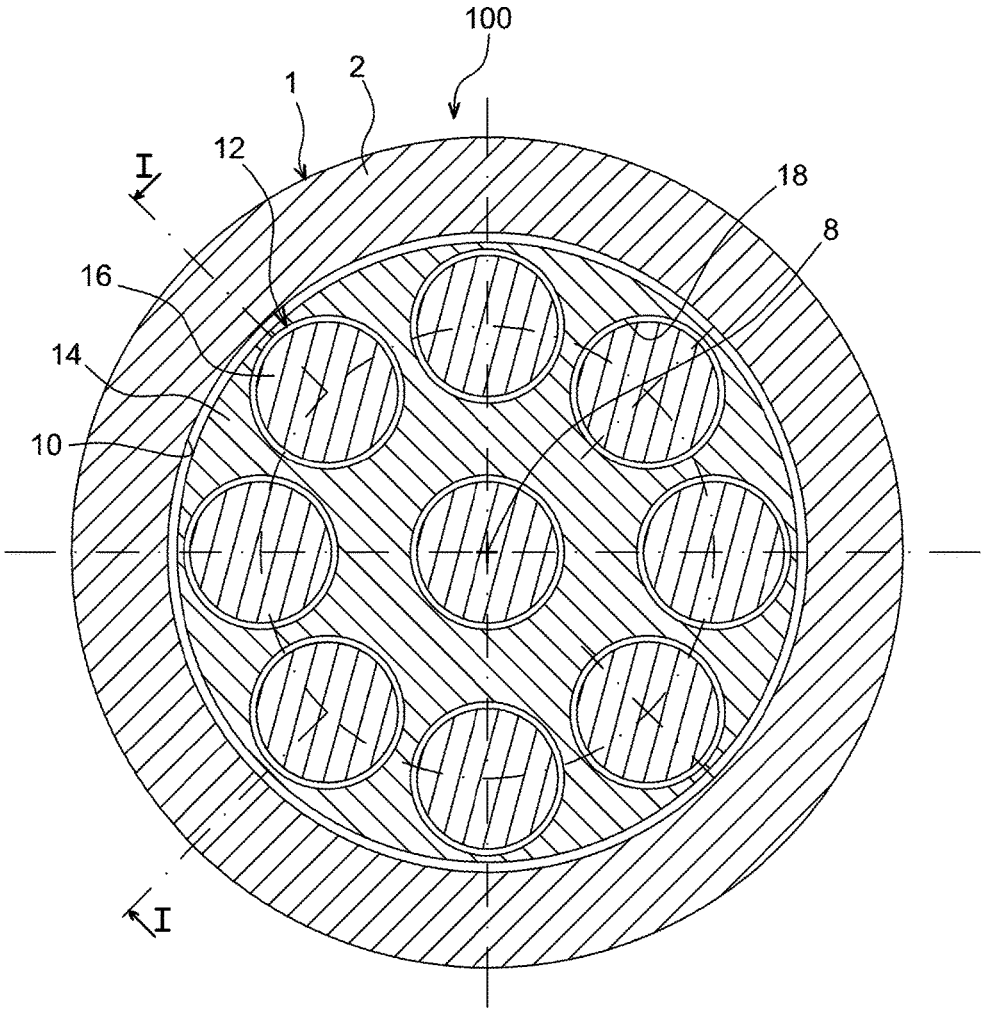
FIG. 2 represents a view of the package taken in transversal section along the line II-II of FIG. 1.

With reference firstly to FIGS. 1 and 2, a package 100 for storing and/or transporting radioactive materials is represented in the form of a preferred embodiment of the present invention.

The package comprises firstly a packaging 1 provided with a lateral body 2, a bottom 4 and a cover 6 closing off an opening of the packaging opposite to the bottom 4. The packaging has a longitudinal axis 8 centred with respect to the lateral body 2, and passing through the cover and the bottom of said same packaging.

The packaging forming the outer containment of the package defines a cavity 10 serving as housing for an assembly 12 containing radioactive materials. Said assembly 12, also centred on the axis 8, here comprises a storage basket 14 and a plurality of devices containing the radioactive materials which are here waste canisters 16. The canisters are here stacked and spread out in several columns, each column being able for example to have two to five canisters stacked on top of each other, preferably by interlocking of their opposite ends two by two.

In the embodiment represented, as may best be seen in FIG. 2, nine columns of canisters are for example provided, eight of which are spread out around the axis 8 of the packaging, and a ninth of which is centred on said same axis 8. Said columns of canisters 16 are placed in housings 18 of complementary shape provided on the basket 14.

As is represented in dotted lines in FIG. 1, at the ends of the package in question along the direction of the axis 8, the packaging may be equipped with dampening overcaps 20 protecting respectively the cover 6 and the bottom 4 of the packaging.

Figure 3:
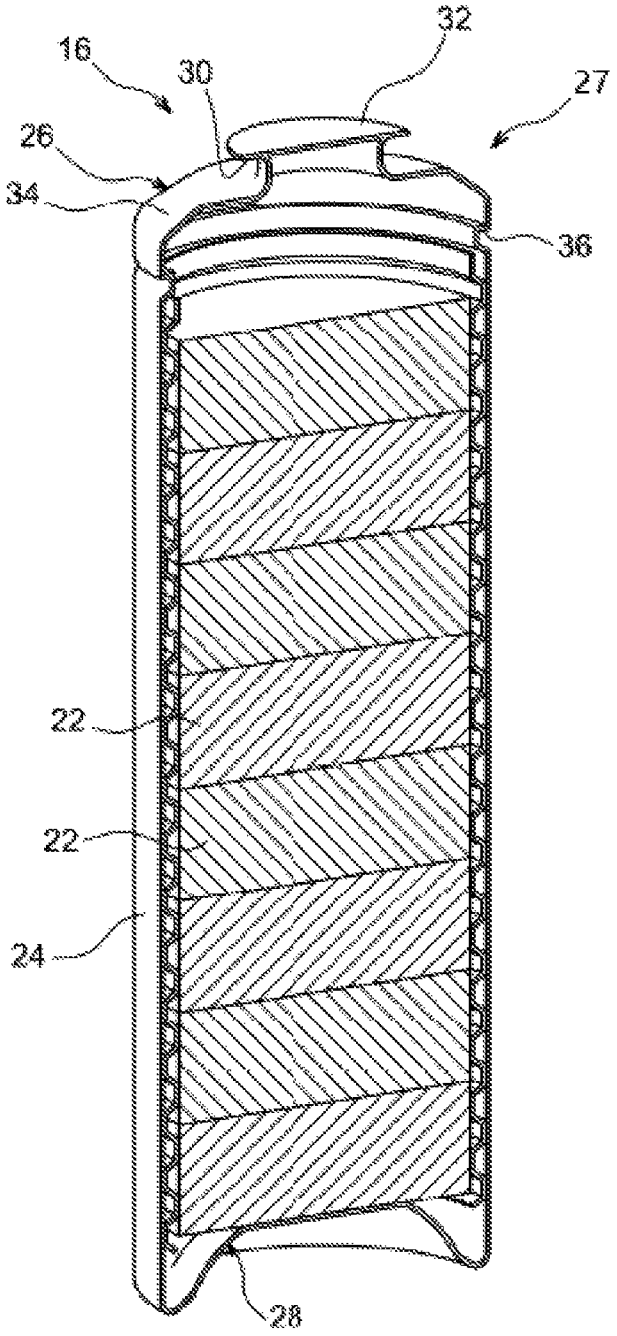
FIG. 3 is a perspective view of part of one of the radioactive waste canisters contained in the package.

With reference to FIG. 3, an example of embodiment for one of the canisters 16 is shown. It may be a standard canister intended to receive compacted wastes, or instead vitrified wastes.

Waste bales 22 integrating the radioactive wastes are placed inside a space defined by a lateral wall 24, at the ends of which are placed a top end 26 and a bottom end 28. Generally speaking, as may be seen in FIG. 3, the top end 26 has a protruding shape, whereas the bottom end 28 has a recess, said two ends of substantially complementary shapes being provided to interlock the canisters together, in order to constitute the aforementioned columns of canisters.

More precisely, as regards the top end, this is conformed so as to enable the handling of the case. Also, the top end 26 takes the general shape of a mushroom defining an annular hold 30 open radially towards the exterior. Towards the top, said hold 30 is defined by an upper plate 32, whereas towards the bottom, it is defined by an annular plate continuing through a portion forming a truncated surface 34 of axis corresponding to the axis of the canister 16. At said top end 26, the plate defining the surface 34 then joins the lateral wall 24, by means of a portion defining an annual groove 36 open radially towards the exterior.

In FIG. 1, the upper end of the canisters has only been roughly represented. Nevertheless, it should be noted that at the head of each of the canister columns, the top end 26 of the canister situated as close as possible to the cover forms an integral part of a system for dampening impacts of the assembly 12 against the cover 6.

More precisely, said dampening system 40 is broken down into several sub-systems 40' each associated with one of the columns of canisters 16. In the envisaged preferred embodiment, the top end 26 enabling the handling of the canister forms both a deformable dampening device in the event of impact, and a loading device 27 of another deformable dampening device 42, mounted on the cover 6. Consequently, it should be understood that in each sub-system 40', the device 42 is at one and the same time a deformable dampening device intended to be loaded by the top end 26 forming loading device, and constitutes on the other hand a loading device of said deformable dampening device formed by the top end of the canister. Also, it should be understood that the loading device 27 and the deformable dampening device 42 are intended to load themselves mutually in the event of axial drop occurring at the head of the package, which enables them both to deform plastically and thereby absorb as best as possible the mechanical impact energy that is linked to said drop, as will be described in greater detail hereafter.

One of the particularities of the present invention resides in the fact that the deformable dampening device 42 is mounted moveable on the inner surface of the cover 6, in a plane orthogonal to the axis 8.

It is thus in this plane corresponding to the inner surface 46 of the cover 6 that the device 42 is capable of being displaced relatively to the cover, by means of an appropriate mechanical link represented only schematically in FIG. 1, and identified by the numerical reference 48. Apart from the moveable mounting of the device 42, the latter has means of self-centring with respect to the loading device 27, said means of self-centring here being realised by means of a truncated surface 50 intended to cooperate with the truncated surface 34 of the loading device 27 forming the handling end of the canister 16. Also, in the embodiment represented, the loading device 27 and the deformable dampening device 42 enable their self-centring through the moveable mounting of the device 42 on the cover 6, and by the implementation of the two truncated self-centring surfaces 50, 34, preferably coaxial, of axis parallel to the axis 8.

In this preferred embodiment, the loading device 27 intended to cooperate with the deformable dampening device 42 is provided on the upper canister of the column associated with sub-system 40'. Nevertheless, an alternative could consist in providing said loading device 27 on the basket 14, without going beyond the scope of the invention. For example, the loading device 27 could then surround the opening of the associated housing 18, at an upper end of the basket 14.

Figure 4A:
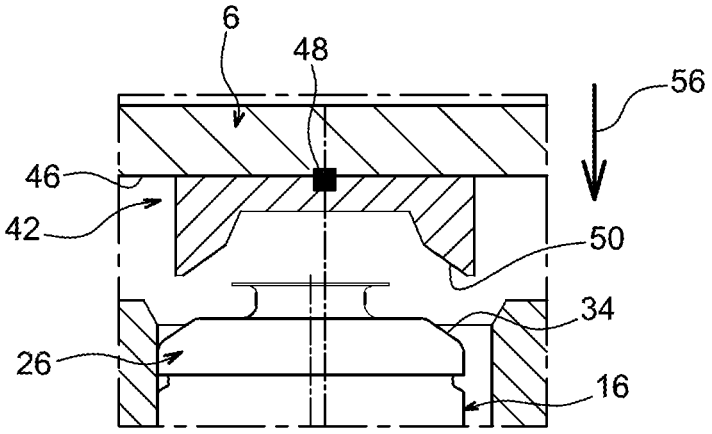
FIGS. 4*a* and 4*b* schematically show different steps of a method of closing the package according to a preferred embodiment of the invention.
Figure 4B:
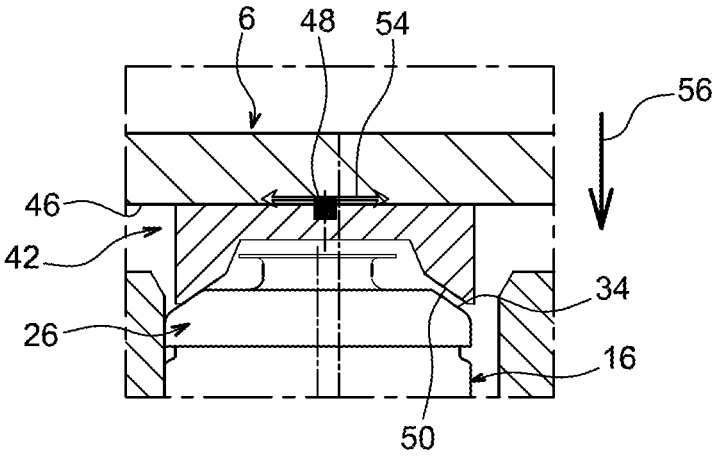

Returning to the preferred embodiment, FIGS. 4*a* and 4*b* schematically show different successive steps of a method of closing the package. Said method comprises a step of self-centring of the deformable dampening device 42 relatively to the loading device 27, the latter, due to its considerable weight, then being immobile throughout the closing step. This step of self-centring is carried out automatically by displacement of the device 42 relatively to the cover 6, thanks to the link 48, as is shown schematically by the arrow 54 in FIG. 4*b*. Said automatic displacement in the plane orthogonal to the axis 8 is the result of the cooperation between the two self-centring surfaces 34, 50, the self-centring being obtained progressively as the cover 6 is put in place on the lateral body of the packaging. In this respect, the placing of the cover 6 axially in the direction of the columns of canisters 16 is shown schematically by the arrow 56 in FIG. 4*a*.

Consequently, by aligning itself progressively and in a very precise manner with the column of canisters, the deformable dampening device 42 enables optimal functioning in the event of impact occurring during an axial drop of the package. This makes it possible to obtain satisfactory dampening of the impact of the assembly 12 against the cover, thereby guaranteeing the leak tightness of the cavity 10 forming confinement enclosure. In fact, thanks to the dissipation of the mechanical impact energy of said assembly 12 against the cover 6, the means of fixing the latter onto the lateral body 2 of the packaging 1 make it possible to better resist risks of radiological leaks and/or disconnection of the cover.

Furthermore, it should be noted that during such an axial drop, the self-centring of the device 42 of each sub-system 40' may continue, when this has not been totally attained during the closing of the cover of the packaging.

Now, with reference to FIGS. 5 to 8*b*, a preferred embodiment of the deformable dampening device 42 will be described.

Figure 5:
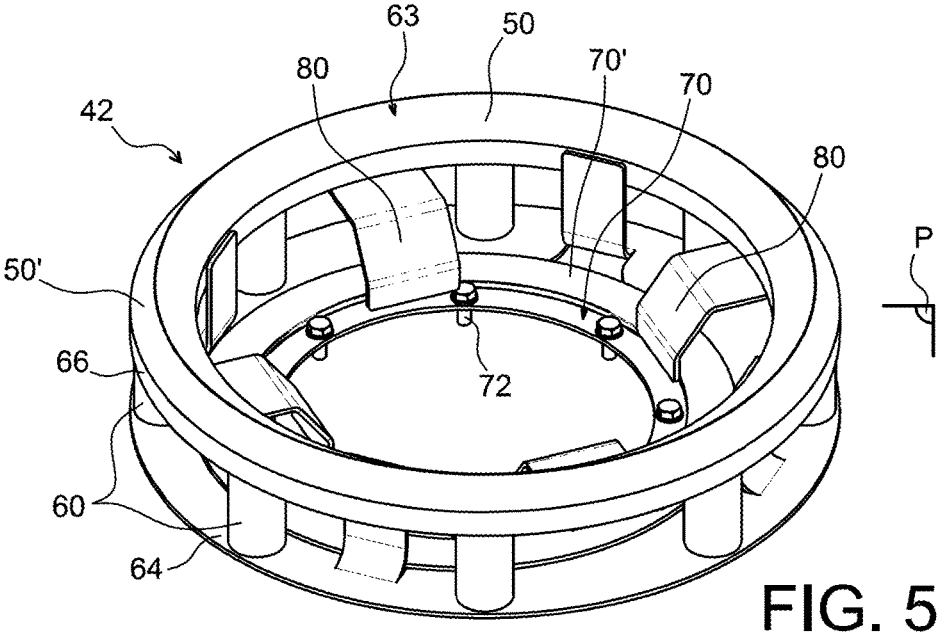
FIG. 5 shows a perspective view of a preferred embodiment of a deformable dampening device intended to equip the package shown in the preceding figures.
Figure 6:
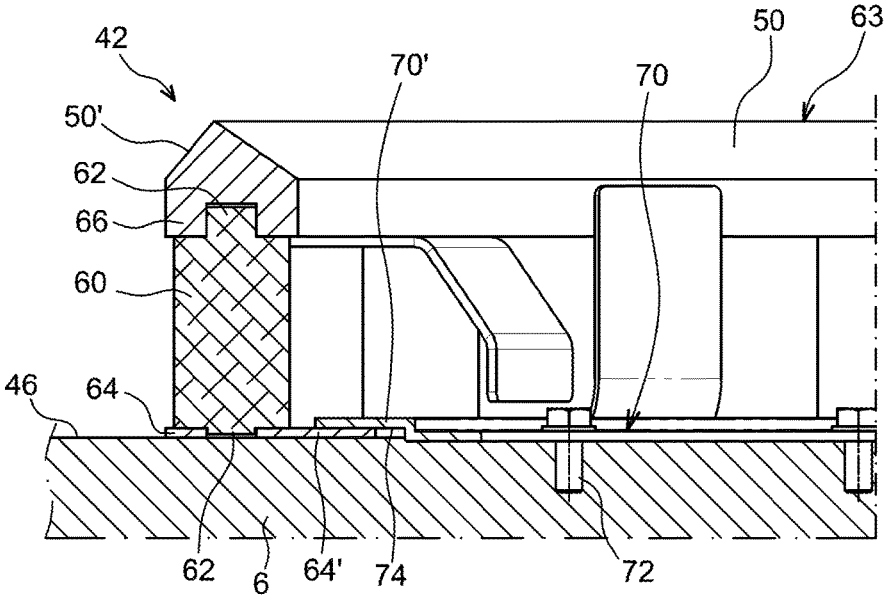
FIG. 6 shows a longitudinal semi-sectional view of the dampening device, taken along plane P of FIG. 5.

Firstly, it should be noted that this device has an overall annular shape, of axis parallel to the longitudinal axis of the packaging. With reference more precisely to FIGS. 5 and 6, the device 42 has a plurality of dampening elements 60 that here take the form of solid or hollow cylinders made of aluminium or of an alloy thereof, or made of any other material renowned for its impact dampening properties by plastic deformation. Each cylinder 60 has at its two opposite ends plugs 62 that are housed in complementary hollowing outs provided on two load distribution plates 64, 66.

The load distribution plate 64 is provided at the interface with the cover 6, preferably near to or in contact with the inner surface 46 of said same cover. The other load distribution plate 66 is here integrated in an annular part 63 defining, opposite the load distribution plate 66, the truncated self-centring surface 50. The dampening elements 60 are thus inserted between the two load distribution plates 64, 66, and spread out uniformly along the circumferential direction along the dampening device 42.

In the embodiment represented in FIGS. 5 and 6, there are eight deformable cylinders that are arranged between the load distribution plates 64, 66. For the mounting of the device 42 on the inner surface 46 of the cover 6, a mounting plate 70 is provided fixedly assembled on said same surface 46, using fixing elements 72 of screw type. The mounting plate 70, of general disc shape, has a central part resting against the surface 46 of the cover, and, at the periphery of said central portion, a recess making it possible to present an annular end 70' at a distance from the surface 46. In fact, between said end portion 70' of the plate 70 and the surface 46, a space 74 is defined in the form of an annular slot open radially towards the exterior. Inserted therein is the inner periphery 64' of the load distribution plates 64, lateral play being provided between the plate 70 and the load distribution plate 64 so as to enable a displacement thereof along all of the directions of the plane orthogonal to the axis 8 of the packaging. Said displacement of limited amplitude being able to occur in any direction of the aforementioned plane, the self-centring capacity of the device 42 is very satisfactory.

Obviously, to enable the free displacement of the inner periphery 64' of the load distribution plate 64, the internal diameter of the inner periphery 64' is strictly greater than the external diameter of the bottom of the slot open radially towards the exterior. The play provided between these two elements is preferably chosen so as to be able to obtain a displacement of the dampening device 42, with respect to a centred position of said same device on the mounting plate 70, going for example up to 30 mm and does so in each of the directions of the plane orthogonal to the axis 8 of the packaging.

Figure 7:
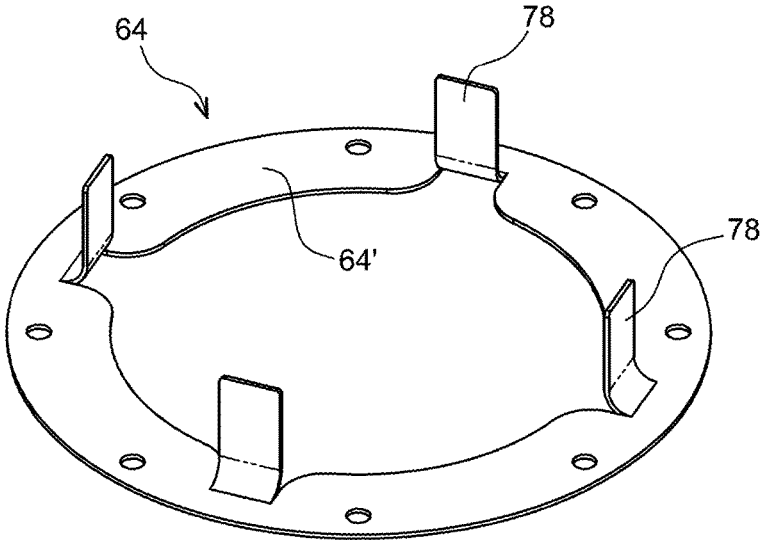
FIG. 7 shows a perspective view of one of the load spreading plates of the dampening device shown in FIGS. 5 and 6.

As may be seen in FIG. 7, the load spreading plate 64 has orifices for receiving plugs 62 of the deformable elements 60, but also has tongues 78 orthogonal to the plane of the plate. Said tongues 78 result preferably from a cutting out within the load distribution plate 64, followed by a bending at 90 degrees of each tongue obtained. Said fixing tongues 78, which are here four in number, are intended to assure the fixation of the load distribution plate 64 on the annular part 63, for example by welding.

Finally, said same annular part 63 comprises several tongues 80 which are fixedly attached thereto, preferably by welding, and which are provided to be able to participate in the self-centring of the device 42 relatively to the corresponding column of canisters. In fact, said tongues 80 have a terminal shape that is inclined so as to bring them closer to the axis of the device 42 going in the direction of the load distribution plates 64. Said pre-centring tongues 80 are situated radially towards the inside with respect to the truncated self-centring surface 50 of the annular part 63, and make it possible for example to cooperate with the end plate 32 of the upper canister of each column, during the placing of the cover on the lateral body of the packaging.

Similarly, the annular part 63 may have another truncated surface 50', adjacent to the surface 50 and forming therewith a V, the tip of which is oriented towards the column of canisters. The surface 50' is also provided to be able to participate in the self-centring of the device 42 relatively to the corresponding column of canisters, while cooperating with a complementary truncated surface 50" formed at the entrance of the housing 18, and shown in FIG. 1.

Figure 9A:
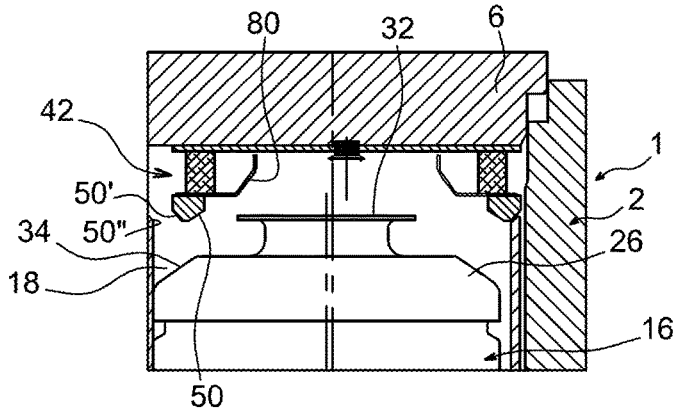
FIGS. 9*a* to 9*c* schematically show different steps of a method of closing a package when it is equipped with the deformable dampening device shown in FIGS. 6 and 7.
Figure 9B:
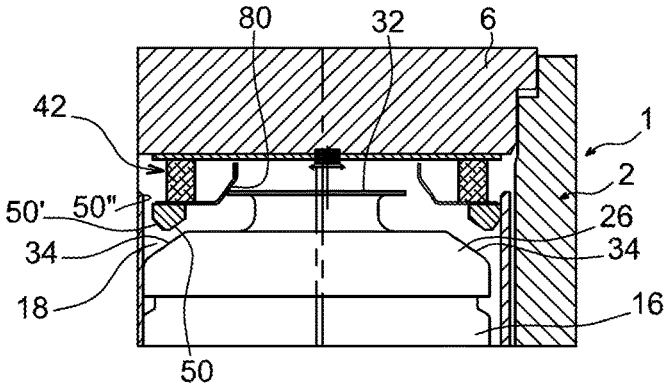
Figure 9C:
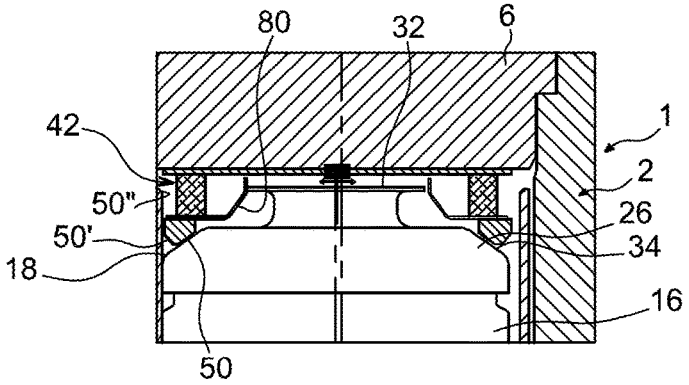

In this respect, FIGS. 9*a* to 9*c* schematically show different steps of a method of closing the package when it is equipped with the deformable dampening device 42 shown in FIGS. 6 and 7.

As evoked above, during the placing of the cover 6 on the packaging body, the self-centring of the device 42 may be achieved by the cooperation of the truncated surfaces 50, 34, and/or by the cooperation of the truncated surfaces 50', 50", and/or by the cooperation of the tongues 80 with the end plate 32 of the canister 16. Obviously, when several of said pairs of elements are active during the placing of the cover, the order in which they take place may be random, depending on the initial position of the dampening device 42 on the cover, and the position of the column of canisters 16 in the housing 18.

Figure 8A:
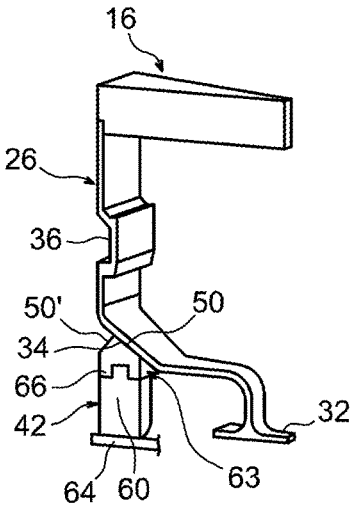
FIGS. 8*a* and 8*b* are views schematically showing the behaviour of the dampening device and that of its associated loading device, during an axial drop.
Figure 8B:
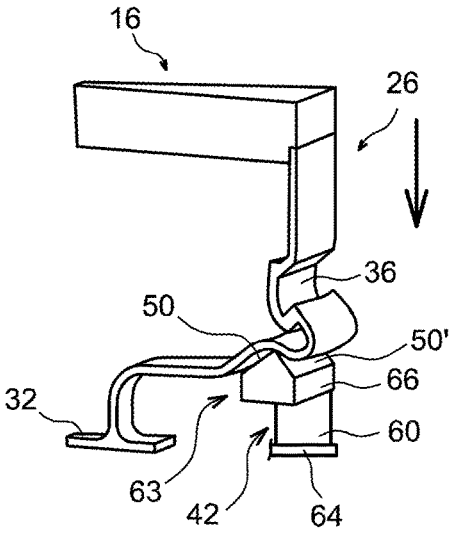

In FIGS. 8*a* and 8*b* is shown respectively the cooperation between the device 42 and the loading device 27 which self-load in order to create their deformation with a view to the dampening of the impact caused by the axial drop of the package, with the cover of the packaging oriented towards the impact surface.

In FIG. 8*a* is shown the cooperation between the loading device 27 and the deformable dampening device 42 before the drop, when the truncated self-centring surfaces 50, 34 cooperate with each other while being in contact. During the drop, as is shown schematically in FIG. 8*b*, it is the assembly of the loading device 27 which deforms, particularly by folding at the level of the annular groove 36 provided for this purpose. Simultaneously, the deformable dampening elements 60 are compressed between the two load distribution plates 64, 66, which leads to their crushing, enabling dissipation of the impact energy.

Obviously, various modifications may be made by those skilled in the art to the invention that has been described, uniquely as non-limiting examples.

What is claimed is:

1. A package comprising:

a packaging for storing and/or transporting radioactive materials;

an assembly containing radioactive materials housed in a cavity of the packaging extending along a longitudinal axis of the packaging and being closed by a cover crossed by said longitudinal axis; and a system for dampening impact of the assembly against the cover, the system comprising at least one plastically deformable dampening device and a loading device, wherein one of the loading device and deformable dampening device is mounted moveable on the cover in a plane orthogonal to the longitudinal axis of the packaging, and has means of self-centring relatively to the other of the loading device and the deformable dampening device which is provided on said assembly containing the radioactive materials, and wherein the deformable dampening device is arranged between the assembly and the cover along the longitudinal axis of the packaging.

2. The package according to claim 1, wherein said loading device is deformable.

3. The package according to claim 1, wherein the assembly comprises a storage basket and canisters containing radioactive materials placed in housings defined by said basket, and in that said other of the loading device and the deformable dampening device is provided on one of the canisters containing radioactive materials or on said basket.

4. The package according to claim 1, wherein said other of the loading device and the deformable dampening device is integrated in a canister containing radioactive materials, preferably at an end dedicated to its handling.

5. The package according to claim 3, wherein each canister takes the form of a nuclear fuel vessel or a nuclear waste canister.

6. The package according to claim 1, wherein said assembly comprises a plurality of canisters, stacked and spread out in several columns, and in that, with each column of canisters is associated the deformable dampening device and its associated loading device.

7. The package according to claim 1, wherein the deformable dampening device and its associated loading device have respectively two truncated self-centring surfaces, of axes parallel to the longitudinal axis of the packaging.

8. A method of closing a package according to claim 1, the method comprising the step of self-centring the deformable dampening device relatively to its associated loading device, the step of self-centring being carried out automatically by displacement of said one of the loading device and deformable dampening device relatively to the cover, in a plane orthogonal to the longitudinal axis of the packaging, during the mounting of the cover on a lateral body of the packaging.

9. A package comprising:

a packaging for storing and/or transporting radioactive materials;

an assembly containing radioactive materials housed in a cavity of the packaging extending along a longitudinal axis of the packaging and being closed by a cover crossed by said longitudinal axis; and a system for dampening impact of the assembly against the cover, the system comprising at least one plastically deformable dampening device and a loading device, wherein one of the loading device and deformable dampening device is mounted moveable on the cover in a plane orthogonal to the longitudinal axis of the packaging, and has means of self-centring relatively to the other of the loading device and the deformable dampening device which is provided on said assembly containing the radioactive materials, and wherein said deformable dampening device has one or a plurality of plastically deformable dampening elements arranged between two load spreading plates.

10. The package according to claim 9, wherein said deformable dampening device has an overall annular shape, said plastically deformable dampening elements being spread out circumferentially along the deformable dampening device.

11. The package according to claim 9, wherein said deformable dampening device comprises a mounting plate fixed on the cover of the packaging, said mounting plate covering a moveable plate of said deformable dampening device, said moveable plate being displaceable in a plane orthogonal to the longitudinal axis of the packaging in a space defined between the mounting plate and the cover, or wherein said loading device comprises a mounting plate fixed on the cover of the packaging, said mounting plate covering a moveable plate of said loading device, said moveable plate being displaceable in a plane orthogonal to the longitudinal axis of the packaging in a space defined between the mounting plate and the cover.

12. The package according to claim 11, wherein said space takes the shape of an annular slot open radially towards the exterior.

13. The package according to claim 11, wherein said moveable plate is one of said load spreading plates.

14. The package according to claim 9, wherein said plastically deformable dampening elements are made of aluminium or of an alloy thereof.

* * * * *